United States Patent [19]

Auerbach

[11] Patent Number: 4,809,142

[45] Date of Patent: Feb. 28, 1989

[54] INTEGRATED LIGHTING DEVICE

[76] Inventor: Seymour Auerbach, 115 Hesketh St., Chevy Chase, Md. 20015

[21] Appl. No.: 98,899

[22] Filed: Sep. 9, 1987

[51] Int. Cl.[4] ..... F21S 1/02; F21S 5/00

[52] U.S. Cl. ..... 362/147; 362/216; 362/260; 315/DIG. 5

[58] Field of Search ..... 362/147, 216, 260; 313/318; 315/DIG. 5, DIG. 7

[56] References Cited

U.S. PATENT DOCUMENTS

| | | | |
|---|---|---|---|
| D. 132,213 | 4/1942 | Miller . | |
| 2,278,951 | 4/1942 | Smith et al. | 362/216 X |
| 2,284,363 | 5/1942 | Boomsma | 362/216 |
| 2,400,381 | 5/1946 | Young | 362/216 X |
| 2,581,185 | 1/1952 | Gordon | 362/260 |
| 2,626,346 | 1/1953 | Stoller | 362/260 |
| 3,112,891 | 12/1963 | Cutler | 362/260 |
| 3,388,248 | 6/1968 | Auerbach | 362/260 |
| 3,508,103 | 4/1970 | Young | 313/109 |
| 3,524,981 | 8/1970 | Auerbach | 362/147 |
| 3,593,021 | 7/1971 | Auerbach | 362/404 |
| 3,836,766 | 9/1974 | Auerbach | 362/216 |
| 3,987,326 | 10/1976 | Lindae | 362/260 X |
| 4,141,061 | 2/1979 | Ford et al. | 362/216 |
| 4,149,226 | 4/1979 | Dalton | 362/216 |
| 4,225,905 | 9/1980 | Moriyama et al. | 362/216 |
| 4,282,563 | 8/1981 | Ohta et al. | 362/216 |
| 4,410,834 | 10/1983 | Witte et al. | 315/58 |
| 4,435,744 | 3/1984 | Russo | 362/260 X |
| 4,458,301 | 7/1984 | Chapman et al. | 362/216 |
| 4,462,066 | 7/1984 | Gibson et al. | 362/251 |
| 4,479,170 | 10/1984 | Richardson | 362/95 |
| 4,507,719 | 3/1985 | Quiogue | 362/404 |
| 4,600,975 | 7/1986 | Roberts | 362/147 |

FOREIGN PATENT DOCUMENTS 953243 3/1964 United Kingdom .

*Primary Examiner*—Ira S. Lazarus
*Assistant Examiner*—Peggy Neils
*Attorney, Agent, or Firm*—Nixon & Vanderhye

[57] ABSTRACT

An integrated lighting device includes a housing having a long-life light source electrically hardwired directly to a source of electrical energy. The housing is mechanically connected to the electrical box or the architectural surface surrounding the source of electrical energy. Electrical energy modifying elements, such as ballast, are hardwired between the electrical energy source and the light source. The entirety of the lighting device is therefore disposable at the end of the useful life of the light source.

32 Claims, 10 Drawing Sheets

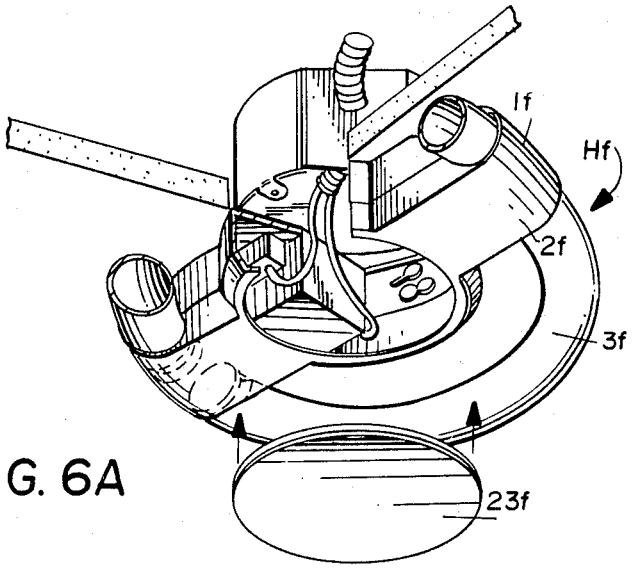
FIG. 6A
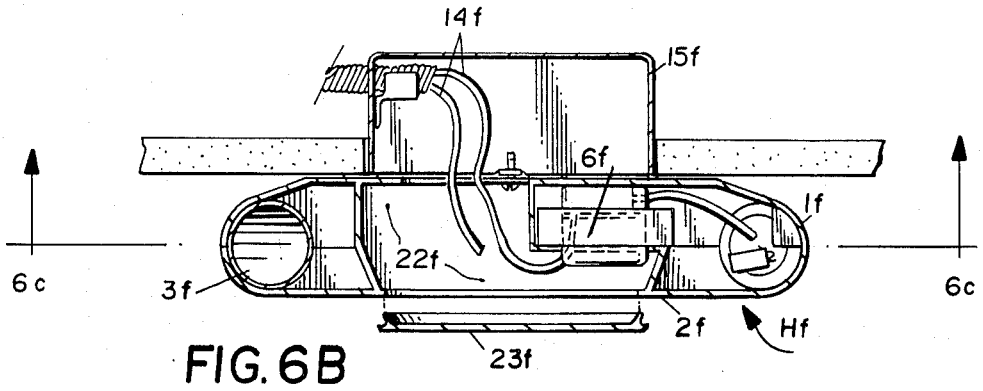
FIG. 6B
FIG. 6C
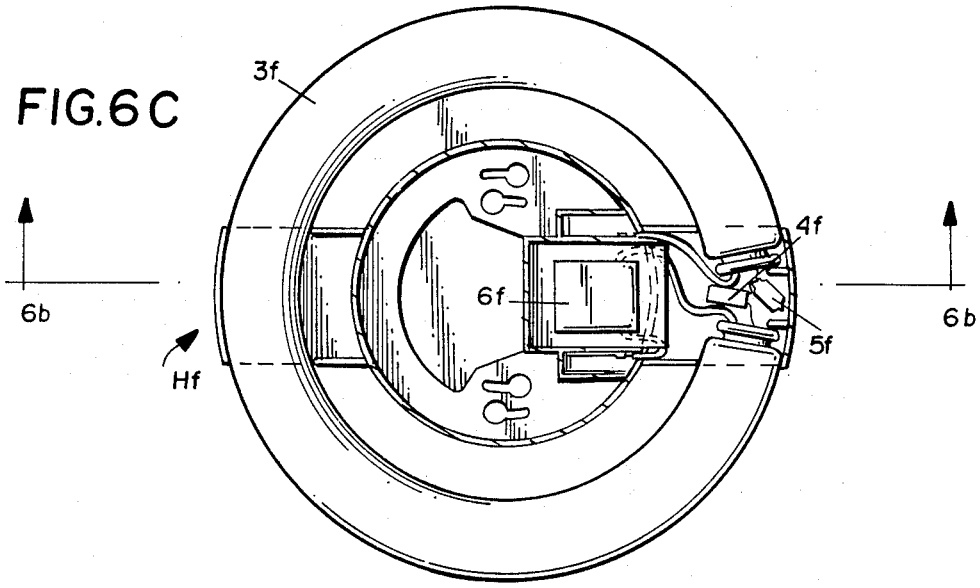

FIG. 10A
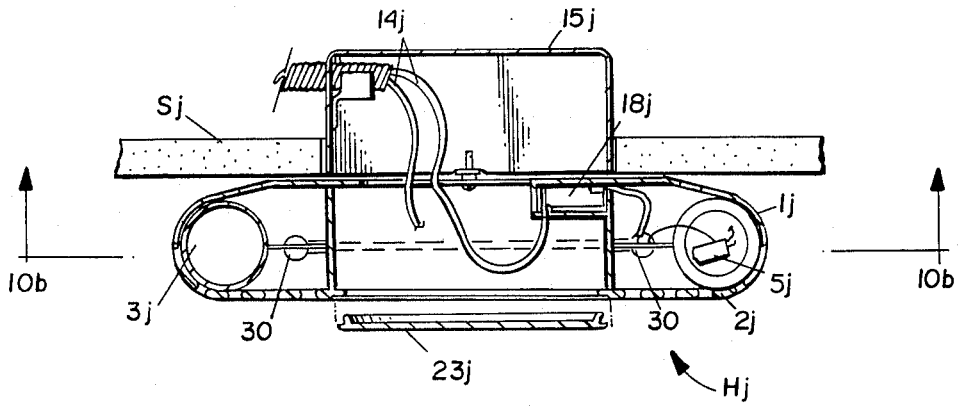
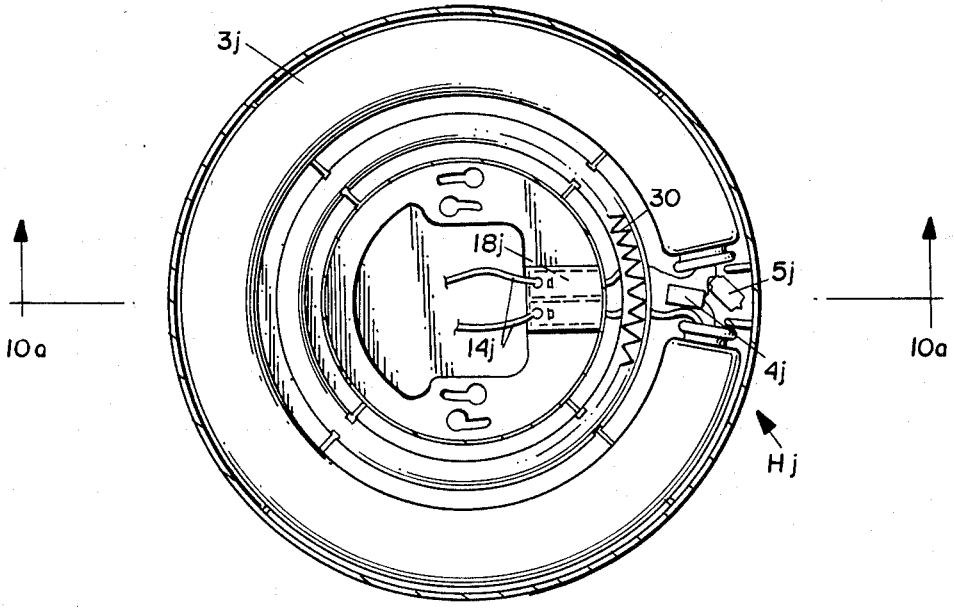
FIG. 10B

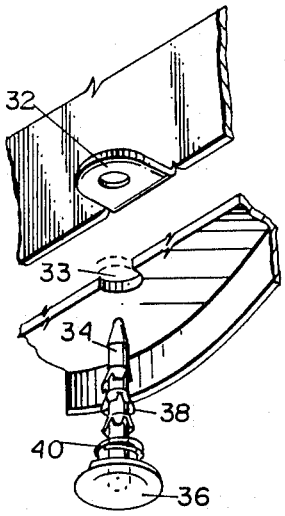
FIG. 11A
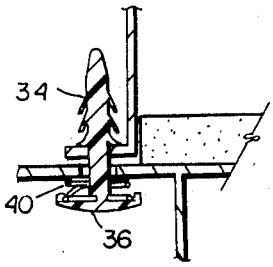
FIG. 11B
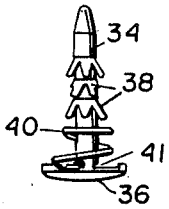
FIG. 11C
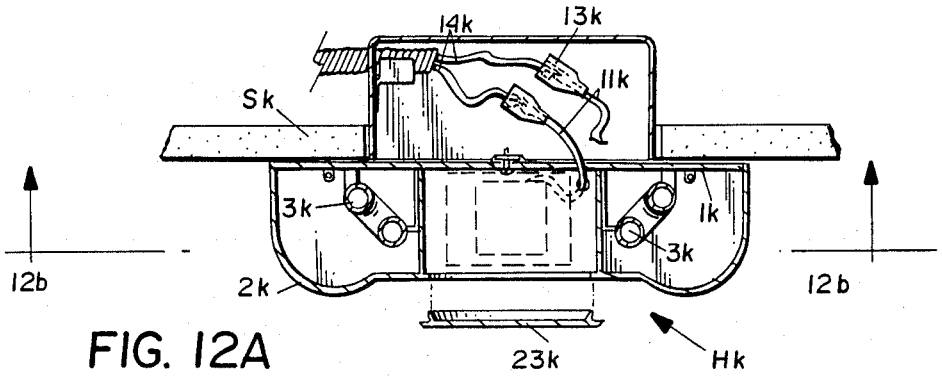
FIG. 12A
FIG. 12B
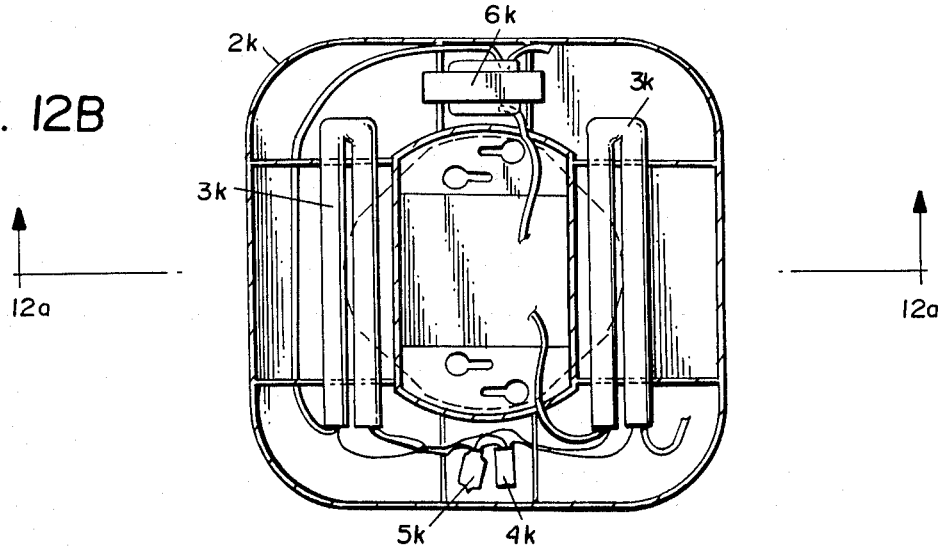

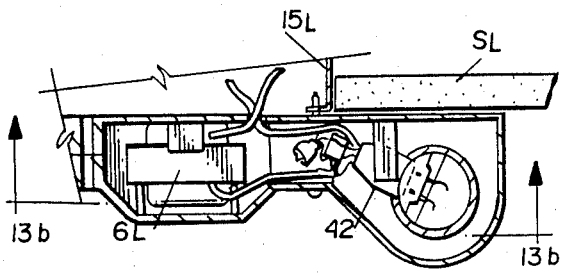
FIG. 13A
FIG. 13B
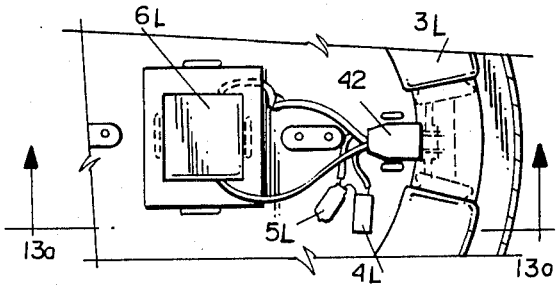
FIG. 14A
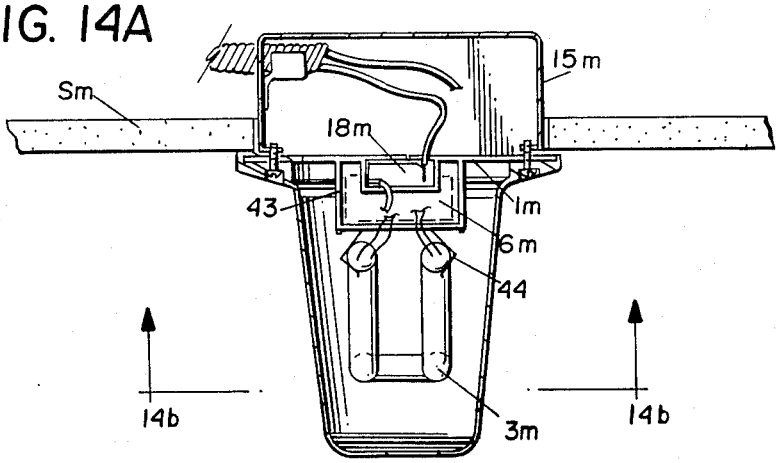
FIG. 14B
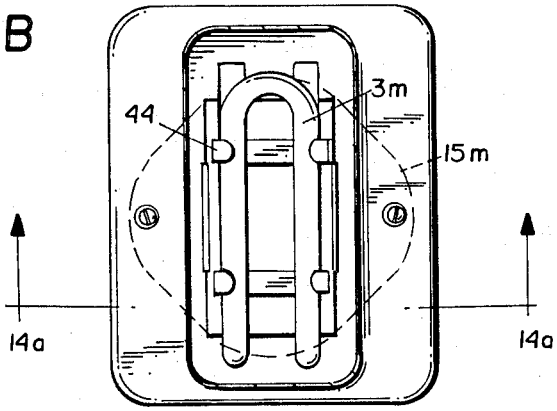

INTEGRATED LIGHTING DEVICE

BACKGROUND AND SUMMARY OF THE INVENTION

The present invention relates to an integrated electric lighting device and particularly relates to a permanently assembled, unitary electric lighting unit which is electrically hardwired directly to a source of electrical energy, i.e., house wiring, and directly mechanically connected to the electrical junction box containing the electrical energy source or the architectural surface surrounding the source of electrical energy.

There is presently a demand on the part of building and home owners for lighting devices which have two distinct advantages: increased length of life of the light source (lamp) and/or increased light output in relation to the amount of electrical energy consumed by the light source. These two sought-after advantages are usually measured in comparison to the commonly-available incandescent bulb. As industry has developed light sources which meet these two demands, a market has developed for lighting devices of increased longevity and decreased energy consumption and in which market existing inefficient light sources, such as incandescent lamps, may be replaced or retrofitted.

Such retrofitting normally involves one of two approaches: one being the removal of the existing inefficient light source and its fixture in their entirety and their replacement with a fixture designed to accept a more efficient light source; the other being the retention of the existing inefficient fixture but the replacement of the light source, usually an incandescent lamp, with a long-life energy-efficient replacement lighting device. This replacement lighting device, in reality, constitutes more than a lamp in that it contains not only the light source but also an electrical energy modifying means such as a ballast, transformer or a resistor in conjunction with a standard lamp base which can be screwed into the retained or any incandescent fixture. In either of these arrangements, it is required that at least two separate items be employed: a light fixture and a light source; one or the other necessarily containing the electrical energy modifying means. Further, these combinations must employ at least one releasable connecting device such as a screw base and socket or plug and socket normally positioned between the lamp and the electrical energy modifying means contained in the fixture or positioned between the incandescent fixture and the so-called "replacement lamp" described above.

These arrangements require a number of redundant or unnecessary sub-components which could be eliminated if the fixture and the lamp were to be combined as in the present invention. If thus combined, the resultant cost may be greatly reduced. By such combination therefore an inexpensive lighting device is producible as a single integrated unit requiring only a hardwire connection to the source of electrical energy and a mechanical connection of the device directly to the electrical junction box or to the architectural surface surrounding the source of electrical energy. The length of lamp life and the greatly-reduced cost of this integrated lighting device, together with the simplicity and safety of its installation, combine to make it economically disposable and replaceable in its entirety at the expiration of its lamp life.

As used herein, light source means any one of long-life, energy-efficient light sources, such as straight, U-shaped or circular fluorescent tube lamps, compact twin-tube fluorescent lamps, often referred to as P-L lamps, double-bent fluorescent tube lamps, often referred to as S-L lamps, fluorescent lamps of other shapes and all sizes, incandescent lamps modified for long life, and high intensity discharge lamps, such as tungsten halogen, mercury vapor, metal halide, high pressure sodium, as well as other similar light sources.

By electrical energy modifying means is meant ballasts, starters, transformers, electronic ballasts, resistance coils, capacitors, electric or electronic devices for extending bulb life, whether internal or external to the lamp, as well as other similar devices, or any combination of the foregoing, as may be required or applicable to the light source employed for altering current or voltage characteristics between the electrical energy source and the light source.

As used in the present invention, hardwiring includes any direct connection between any two or more wires such as twisted or soldered direct connections, connections made by wire nuts, solderless electrical terminals, screw terminals, bayonet or blade connectors, crimp connections, so-called quick connect wiring devices and other means whereby a more or less permanent connection is effected. It excludes typical connectors made for temporary convenience, such as screw bases and sockets, or convenience sockets and plugs.

It is therefore a primary object of the present invention to provide a compact integrated lighting unit which is readily and easily hardwired to a source of electrical energy without an accessible intermediate releasable connecting device such as a lamp base and socket, plug and socket, or other such temporary or convenience electrical connecting devices normally required in the installation of a light source into its supporting light fixture.

It is another object of the present invention to provide an inexpensive lighting unit fixedly and permanently incorporating a long-life light source which is easily and safely installable to achieve hardwire electrical and mechanical connections by unskilled lay persons and which is readily and economically replaceable in its entirety at the end of the life of the light source.

Accordingly, in a preferred aspect of the present invention, there is provided an integrated lighting device for mounting to either an electrical box having an electrical energy source or the surface surrounding the electrical energy source comprising a light source, a housing, means non-removably and fixedly mounting the light source and the housing one to the other, means for supplying electrical energy from the electrical energy source to the light source including means for modifying the electrical energy supplied to the light source, means carried by the housing for mechanically connecting the housing to one of the electrical box and the surface surrounding the energy source and the electrical energy supplying means for supplying electrical energy between the electrical energy source and the electrical energy modifying means including at least one hardwire electrical connection therebetween and excluding any connection other than a hardwire connection therebetween.

In a preferred embodiment, the lighting device comprises a housing which may, for example, include a backplate and diffuser cover more or less permanently attached one to the other or which may be integrally formed and which contains a light source, electrical energy modifying means required by the light source and held fixedly in place by a variety of fins, protrusions and other extensions integrally formed with, or attached to, the housing, the entire assembly having means by which a hardwired connection may be made to the electrical energy source (house wiring) and also having means by which the device may be mechanically connected to a junction box or to an architectural surface surrounding the house wiring, whether the house wiring lies in a junction box or not and without the interposition of a separate fixture, such as a mounting plate or base. The shape and dimensions of the housing may be devised to provide thermal protection from and electrical insulation for the light source and the electrical elements contained therein, the housing being compatible with the size and shape of the light source and the electrical modifying means elements.

These and further objects and advantages of the present invention will become more apparent upon reference to the following specification, drawings and claims.

BRIEF DESCRIPTION OF THE DRAWING FIGURES

FIG. 6A is a view similar to FIG. 1A illustrating a still further embodiment of the present invention wherein the housing encloses the electrical elements and leaves a portion of the lamp exposed to view;

FIGS. 6B and 6C are cross-sectional views thereof taken generally on lines **6*b*—6*b* in FIG. 6C and 6*c*—6*c* in FIG. 6B**, respectively;

FIG. 10A is a cross-sectional view of a further embodiment of the present invention taken approximately on line **10*a*—10*a* in FIG. 10B** wherein one of the electrical modifying means elements is a resistance coil;

FIG. 10B is a cross-sectional view thereof taken generally about on line **10*b*—10*b* in FIG. 10A**;

FIG. 11A is an enlarged fragmentary perspective view of an example of a quick connect device for mounting the lighting fixture hereof to a junction box;

FIG. 11B is a cross-sectional view thereof taken through the quick connect device shown in FIG. 11A;

FIG. 11C is a side view of the quick connect device shown in FIGS. 11A and 11B;

FIG. 12A is a ross-sectional view of a further embodiment of the present invention taken generally about on line **12*a*—12*a* in FIG. 12B** illustrating two light sources generally known in the market as P-L type twin tube fluorescent lamps;

FIG. 12B is a cross-sectional view thereof taken generally about on line **12*b*—12*b* of FIG. 12A**;

FIG. 13A is a partial cross-sectional view of an embodiment of the present invention taken approximately on line **13*a*—13*a* of FIG. 13B** illustrating a standard four-pin socket and plug used to connect the electrical elements to a light source within the housing;

FIG. 13B is a partial cross-sectional view thereof taken generally about on line **13*b*—13*b* of FIG. 13A**;

FIG. 14A is a cross-sectional view of an embodiment of the present invention taken approximately on line **14*a*—14*a* of FIG. 14B and showing a light source generally known in the market as an S-L type double-bent fluorescent tube; and FIG. 14B is a cross-sectional view thereof taken approximately on line 14*b*—14*b* of FIG. 14A**.

DETAILED DESCRIPTION OF THE DRAWING FIGURES

Figure 1A:
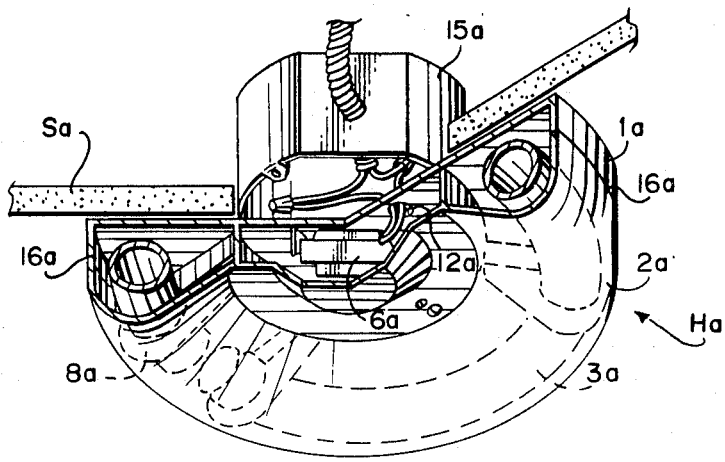
FIG. 1A is a perspective view with parts broken out and in cross-section illustrating an integrated light fixture constructed in accordance with the present invention wherein the hardwire connection to the house wiring is made within a junction box prior to securing the lighting device in place.

Reference will now be made in detail to the present preferred embodiment of the invention, examples of which are illustrated in the accompanying drawings.

In the sequence of drawings of the various preferred embodiments, like parts will be denoted by like reference numerals followed by differing suffixes (a, b, c, etc.) in the ensuing drawings.

An integrated lighting device constructed in accordance with a preferred embodiment of the present invention is illustrated in FIGS. 1A, B and C. Such lighting device essentially comprises a housing, generally designated Ha, comprised of a backplate 1a and diffuser face 2a which contains a circular fluorescent lamp 3a. Lamp 3a is provided without its conventional plug-in base and is wired to well-known electrical energy modifying means, e.g., capacitor 4a, initiator switch 5a and transformer or ballast 6a by hardwired electrical wiring 7a, as applicable. It is to be understood that the hardwired connection may be made by any of a number of means as indicated above. It will also be appreciated that the lamp 3a, and the lamps of subsequent embodiments herein, may comprise any one of the light sources identified previously and that the present description and illustrations refer to fluorescent-type lamps for convenience herein rather than as limiting.

The lamp and electrical energy modifying means are fixedly held in place by fins or ribs 8a, 9a and 10a, which are formed as integral parts of backplate 1a or diffuser 2a. Electrical wiring 11a from the electrical energy modifying means and the lamp extend through a hole 12a in the backplate to permit a hardwired connection 13a to the source of electrical energy (house wiring) 14a within an electrical junction box 15a. The backplate 1a and the diffuser 2a are permanently affixed to each other along their mating edges 16a by an appropriate cement. It is to be understood that, alternatively, the backplate and the diffuser may be affixed to each other by mechanical means such as drive pins, screws, wedge-fitted interlocks cast as an integral part of the backplate and diffuser or other similar devices.

Housing HA is connected to the junction box by means of screws 17a. It is to be understood that, alternatively, the housing may be affixed to the architectural surface (ceiling, wall or the like) Sa which surrounds the junction box 15a or the energy source in the absence of a junction box. It is also to be understood that a quick connect device similar to that illustrated in FIGS. 11A–11C, to be described, may be substituted for screws 17a. Diffuser 2a may be made of any number of transparent or translucent materials, such as plastic, and may have a reticulated or other light-diffusing surface. The backplate may be made of any number of materials, such as translucent or opaque plastic or metal.

Figure 1B:
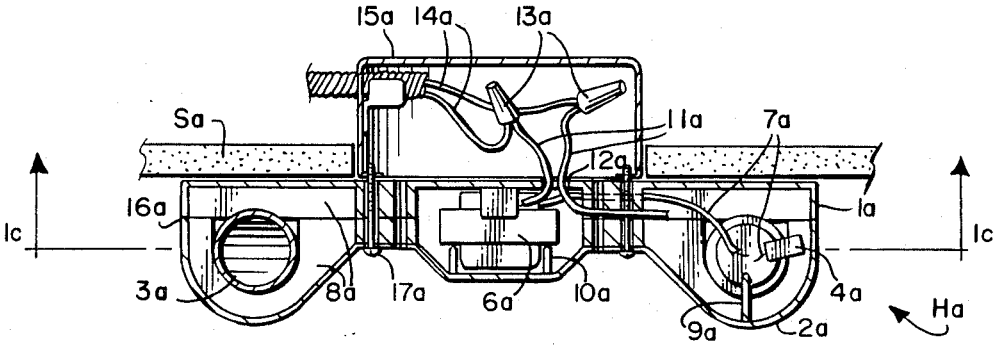
FIGS. 1B and 1C are cross-sectional views thereof taken generally about on lines **1*b*—1*b* in FIG. 1C and 1*c*—1*c* in FIG. 1B**, respectively.
Figure 1C:
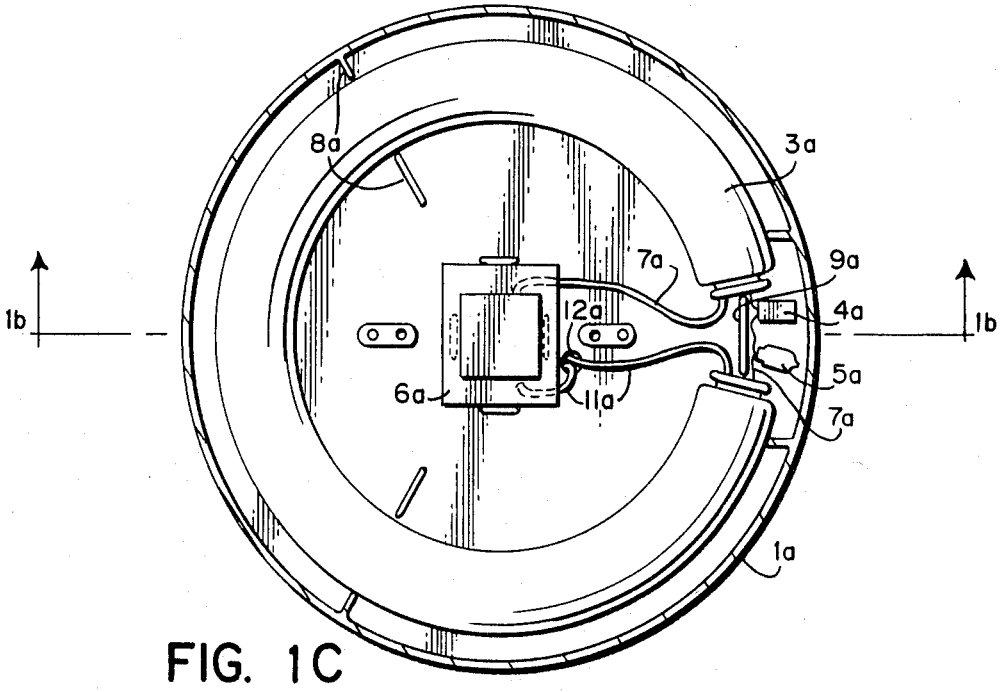
Figure 2A:
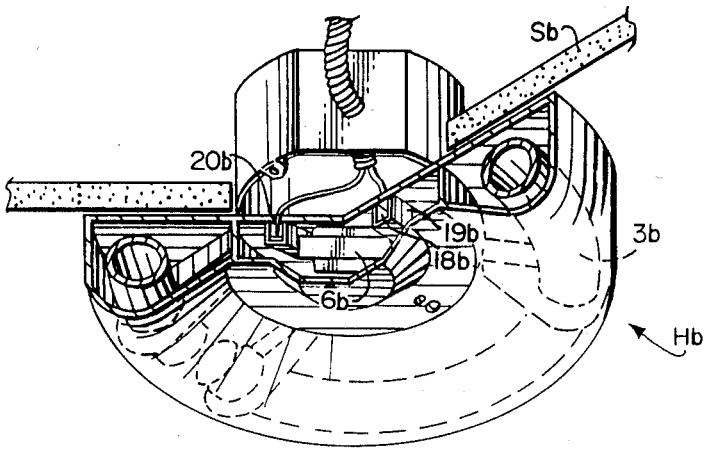
FIG. 2A is a view similar to FIG. 1A illustrating another embodiment of the present invention wherein the hardwire connection to the house wiring is made by means of a quick connect device prior to securing the lighting device in place.
Figure 2B:
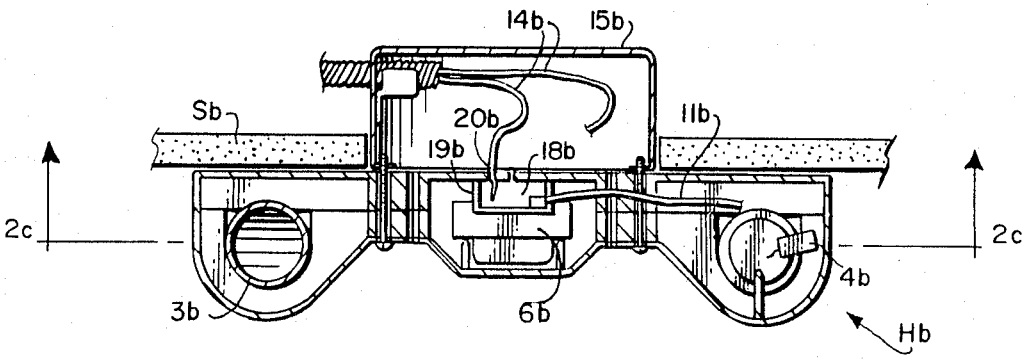
FIGS. 2B and 2C are cross-sectional views thereof taken generally about on lines **2*b*—2*b* in FIG. 2C and 2*c*-2*c* in FIG. 2B**, respectively.
Figure 2C:
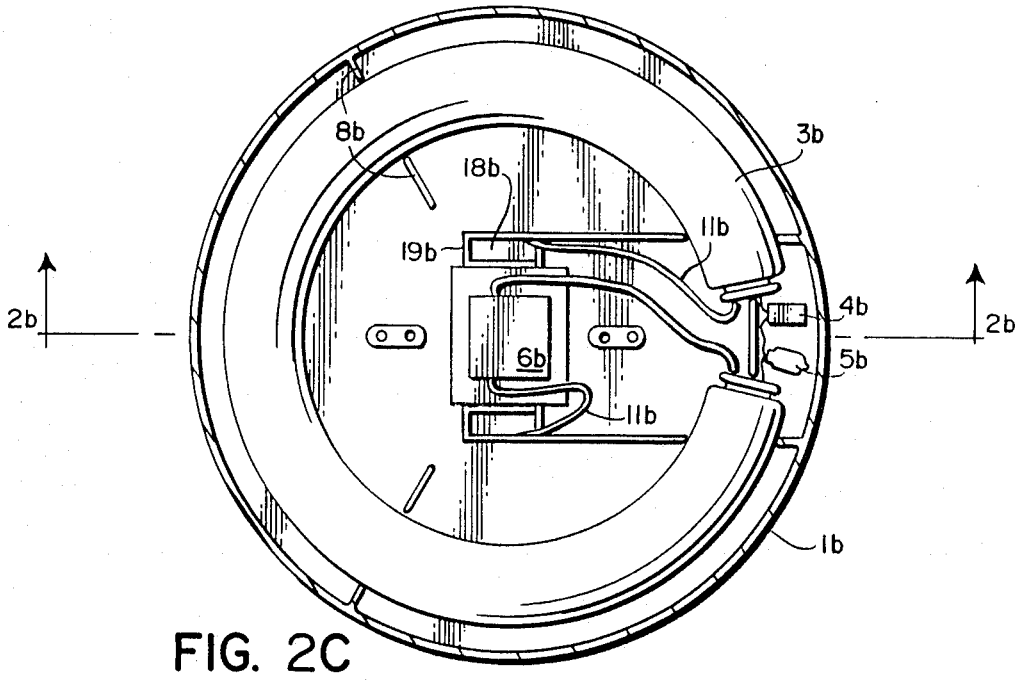

FIGS. 2A–2C illustrate an integrated lighting device similar to that shown in FIGS. 1A–1C, with the exception that the electrical wiring 11b from lamp 3b and electrical energy modifying means 4b, 5b and 6b are hardwired to quick connect devices 18b, preferably fixedly held in compartment 19b formed integrally with the housing. Thus, prior to installation, the house wiring 14b is stripped of its insulation for approximately ½ inch back from its ends and the uninsulated portion is inserted into holes 20b in the backplate to make a firm hardwired connection with the electrical quick connect devices 18b. After the lighting device is thus electrically connected to the housing wiring, it is secured to junction box 15b or the ceiling or wall surface surrounding the junction box, as described above with reference to FIGS. 1A–1C.

Figure 3A:
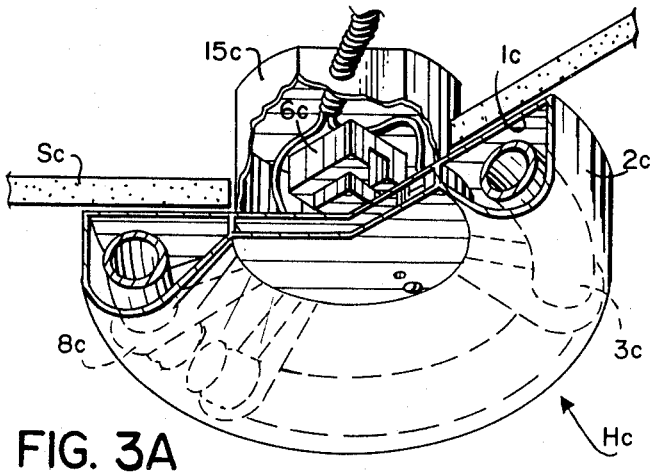
FIG. 3A is a view similar to FIG. 1A illustrating still another embodiment of the present invention wherein at least a portion of the electrical elements of the device are carried on the outside of the housing and fit into the junction box when the lighting device is secured in place.
Figure 3B:
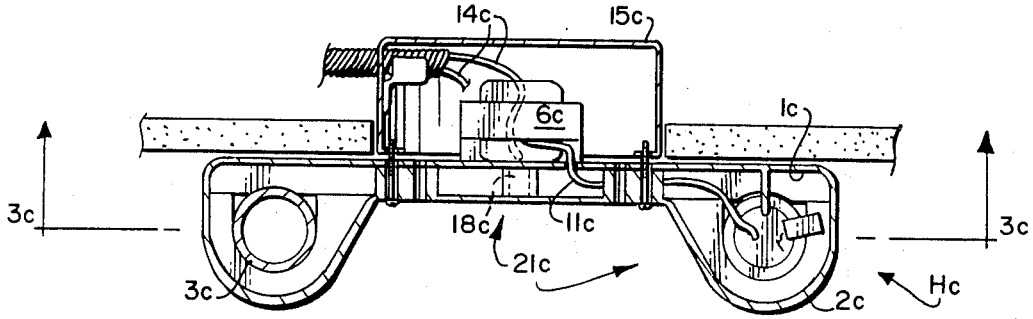
FIGS. 3B and 3C are cross-sectional views thereof taken generally about on lines **3*b*—3*b* in FIG. 3C and 3*c*—3*c* in FIG. 3B**, respectively.
Figure 3C:
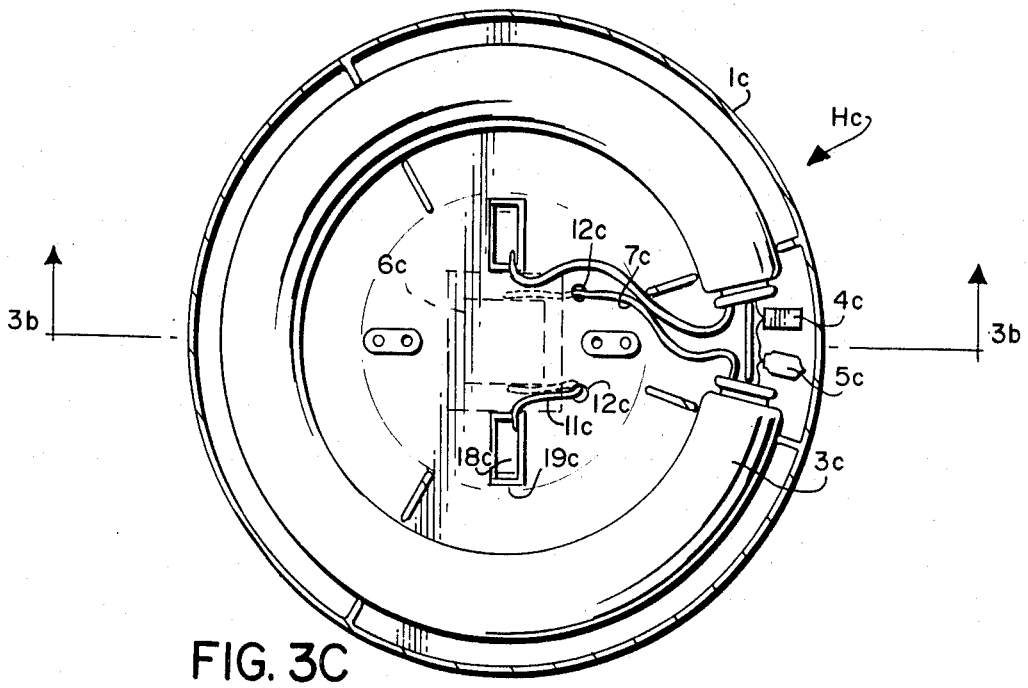

FIGS. 3A–3C illustrate an integrated lighting device similar to that shown in FIGS. 2A–2C with the exception that at least a portion of the electrical modifying energy means 4c, 5c and 6c is mounted on the outside of the lighting device, i.e., externally of the rear surface of backplate 1c. Upon installation, the electrical modifying means 6c will be located within the electrical junction box 15c, permitting a deeper recessed portion 21c of diffuser 2c. This enables a greater transmission of light from lamp 3c through diffuser 2c. Electrical wiring 7c and 11c for connection of the portion of the electrical energy modifying means located outside housing Hc and the lamp and other electrical elements located within the housing extends through holes 12c in the backplate 1c. The house wiring 14c is connected to quick connect devices 18c fixedly held in compartments 19c formed integrally with the housing. It is to be understood that the quick connect devices 18c may be replaced by any number of hardwired connections in a manner similar to that shown in FIG. 1B.

Figure 4A:
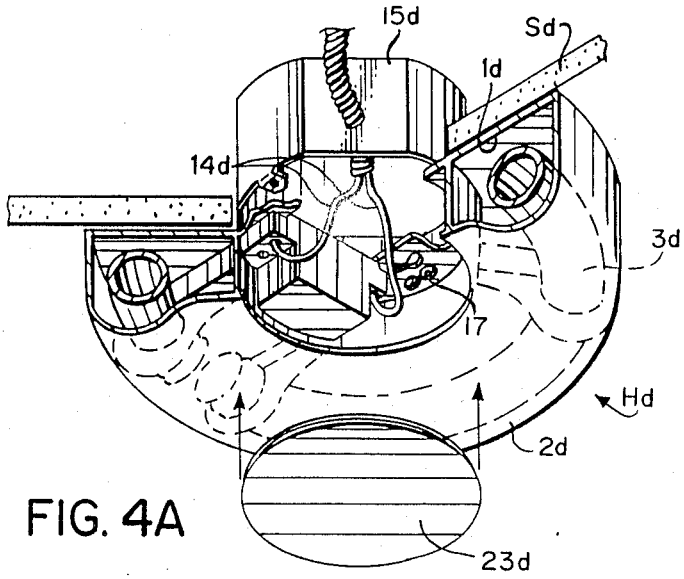
FIG. 4A is a view similar to FIG. 1A illustrating another embodiment of the present invention wherein the connection to the house wiring is made after the lighting device is secured in place and wherein an opening is provided through the lighting device for access to the junction box.
Figure 4B:
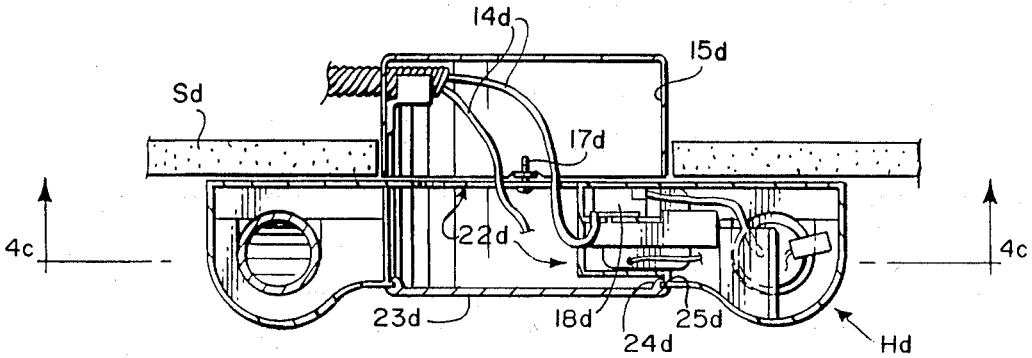
FIGS. 4B and 4C are cross-sectional views thereof taken generally about on lines **4*b*—4*b* in FIG. 4C and 4*c*—4*c* in FIG. 4B**, respectively.
Figure 4C:
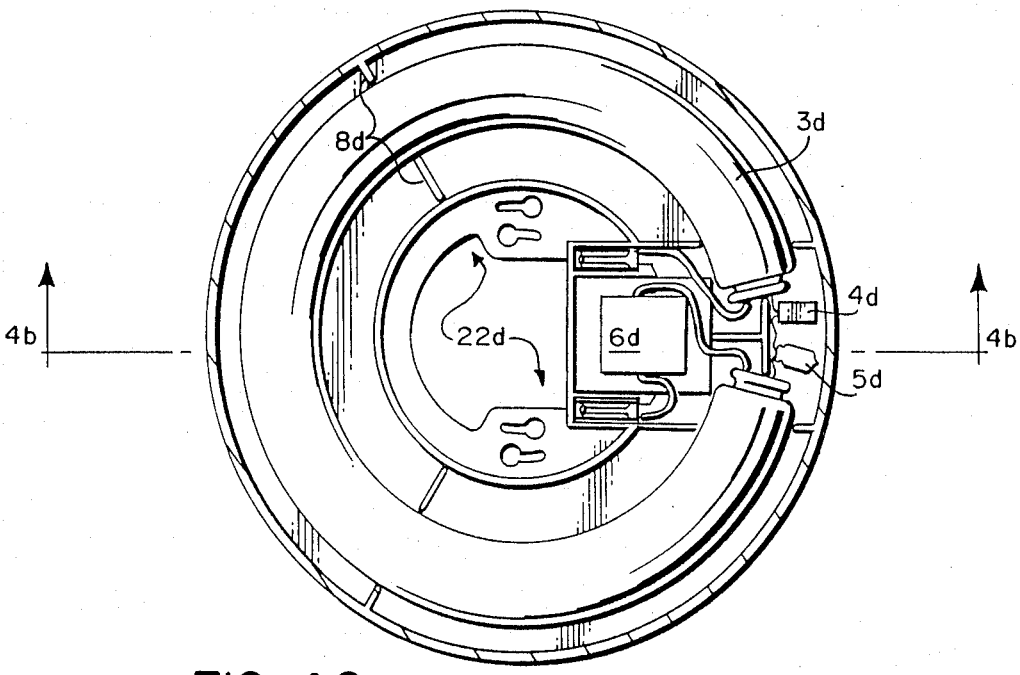

FIGS. 4A–4C illustrate an integrated lighting device similar to those previously shown, except that the housing may be secured to the junction box or surrounding ceiling or wall surface prior to effecting the hardware connection to the house wiring, for example, as disclosed in my prior U.S. Pat. No. 3,836,766. Thus, housing Hd may be first mechanically secured by screws 17d to junction box 15d or to the surrounding ceiling or wall surface Sd. Access into the junction box 15d and the house wiring 14d is afforded by an accessway 22d comprised, for example, of an opening and a compartment through housing Hd. This permits hardwire connection of the house wiring to quick connect devices 18d contained within the insulating enclosure of the housing, thus supplying electricity to the lamp 3d and electrical energy modifying means of the integrated lighting device. It will be understood that the connection of the house wiring may be made by any number of hardwired connections known in the trade in place of the quick connect devices shown. It is to be understood that the electrical modifying means, in whole or in part, may be disposed in the accessway 22d. After the house wiring is connected, the opening 22d to junction box 15d is covered with a lid 23d which carries an annular projecting head 24d. Head 24d cooperates with an annular band 25d carried on the housing to secure the lid in place. It will be understood that alternatively lid 23d may be secured to the housing by other means, such as screws, quick connect devices, a hinge and latch combination, all of which are well known to the trade.

Figure 5A:
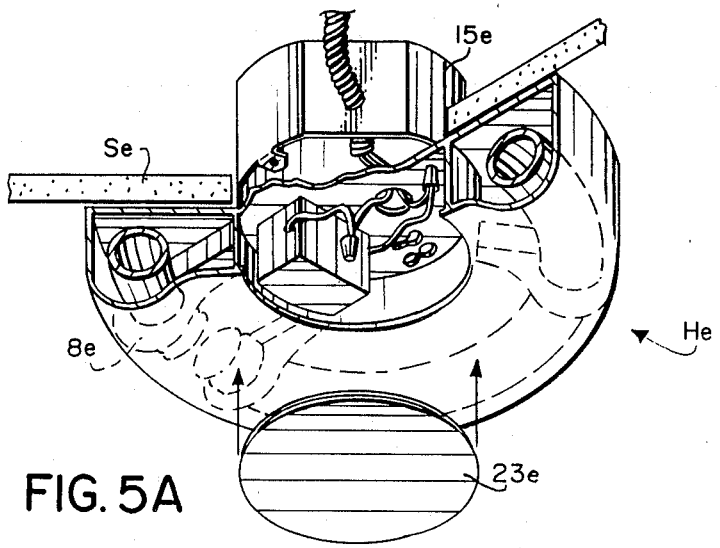
FIG. 5A is view similar to FIG. 1A illustrating a further embodiment of the present invention wherein a hardwire connection to the house wiring is made after the lighting device is secured in place, a hole being provided in the backplate of the device through which the house wiring is pulled prior to securing the lighting device in place.
Figure 5B:
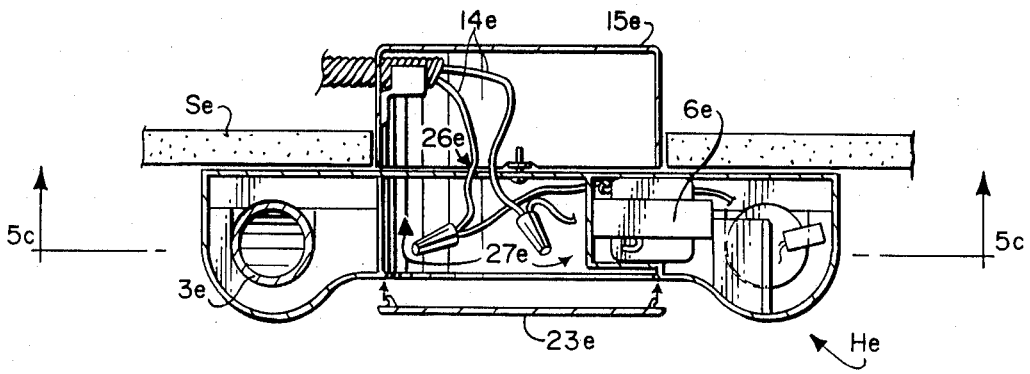
FIGS. 5B and 5C are cross-sectional views thereof taken generally about on lines **5*b*—5*b* in FIG. 5C and 5*c*—5*c* in FIG. 5B**, respectively.
Figure 5C:
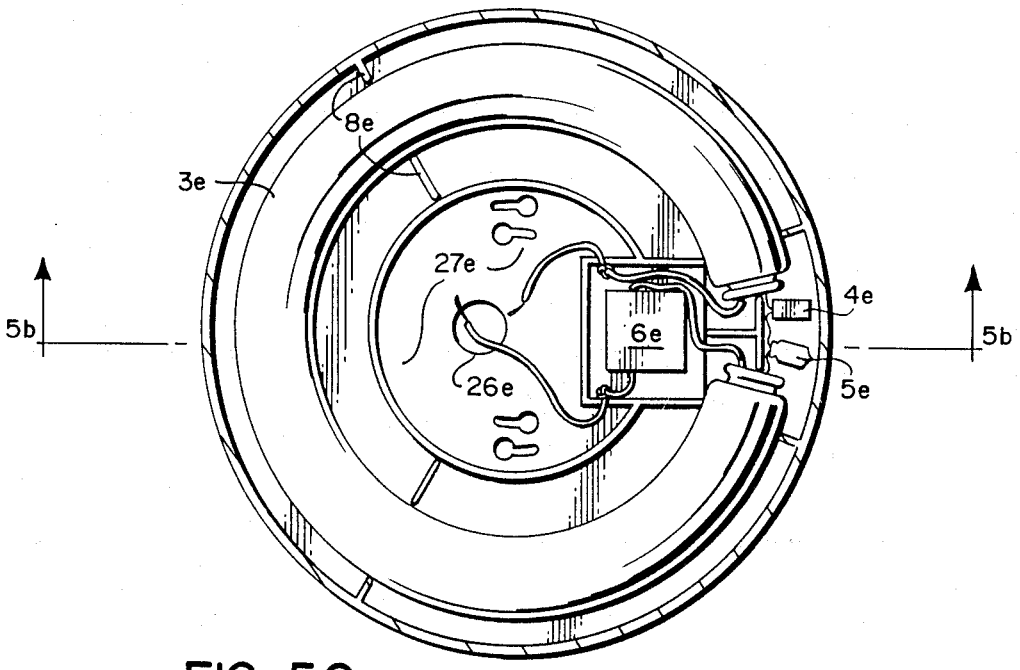

FIG. 5A–5C illustrate an integrated lighting device similar to that shown in FIGS. 4A–4C, with the exception that complete access into the junction box is not provided. Instead, prior to securing the housing He to junction box 15e or the surrounding wall or ceiling surface, the house wiring 14e is inserted through a hole 26e in the backplate 1e, and a hardwired connection of the house wiring 14e to the integrated lighting device is made within a compartment 27e within the housing. Pigtail connections are used for this connection but it will be understood that the connection of the house wiring may be made with quick connect devices as shown in FIGS. 4A–4C or by any number of hardwired connections known in the trade. Similarly as in the embodiment of FIGS. 4A–4C, the electrical modifying means, in whole or in part, may be disposed in the compartment 27e. After the wiring is thus accomplished, the compartment 27e is covered by lid 23e in the same manner as described in FIGS. 4A–4C.

FIGS. 6A–6C illustrate an integrated lighting device similar to that shown in FIGS. 4A–4C and FIGS. 5A–5C, except that the housing Hf does not fully enclose the lamp 3f. In this form, housing Hf includes a backplate 1f and faceplate 2f, which extend diametrically from the central portion of the lighting device to encompass the lamp 3f. That is, backplate 1f and faceplate 2*f* essentially constitute bands or strips extending diametrically from the central portion of the light device to enclose only a portion of lamp 3*f*. As illustrated in FIG. 6C, the ends of the lamp 3*f* terminate within the enclosure provided by the bands 1*f* and 2*f* for connection to the electrical modifying means. It will be appreciated that backplate 1*f* is annular in shape in the middle of the light fixture and projects radially from opposite sides thereof in the form of bands or strips to overlie the corresponding band or strip portion of faceplate 2*f*. As in the prior embodiments, the light device of this embodiment may be mechanically attached to the junction box or the architectural surface surrounding the junction box or the source of electrical energy prior to electrically connecting the house wiring to the electrical modifying means by the quick connect devices. It will be understood, however, that this embodiment may be so constructed as to provide no access to the junction box through the lighting device therefore requiring that the hardwire electrical connection to the house wiring be effected prior to mechanical connection of the light device to the junction box or the architectural surface as in the embodiments depicted in FIGS. 1A–1C, 2A–2C and 3A–3C. It will be further understood that this embodiment may be so constructed to provide a hole through the backplate through which the house wire may be inserted prior to securing the housing to the junction box or the surrounding wall or ceiling surface as shown in FIGS. 5A–5C. The electrical modifying means 4*f*, 5*f* and 6*f*, in whole or in part, may be disposed in the accessway 22*f*, similarly as in FIGS. 4A–4C or in a compartment similarly as in FIGS. 5A–5C. The lid 23*f* is disposed in the central opening to cover the wiring connections and ancillary electrical and mechanical devices.

Figure 7:
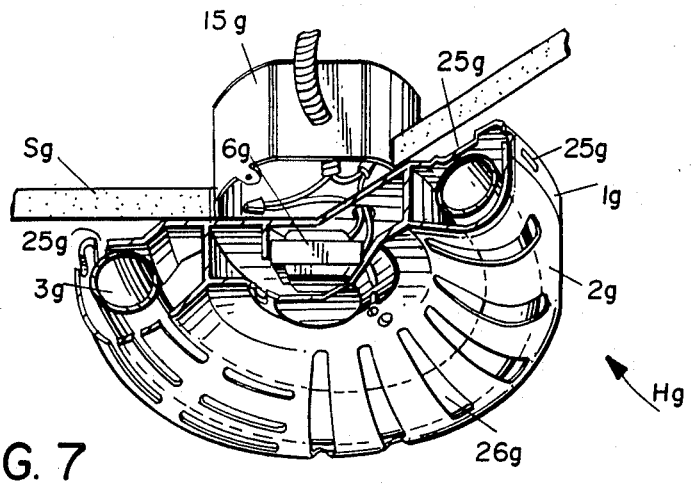
FIG. 7 is a view similar to FIG. 1A illustrating yet another embodiment of the present invention illustrating a variety of openings in the housing provided for decorative or ventilation purposes.

Referring now to FIG. 7, there is illustrated a lighting device similar to that disclosed in FIGS. 1A–1C. However, in this form, various apertures are formed in the backplate 1*g* and the diffuser 2*g* for purposes of dissipating heat, improving illumination and for decorative purposes. The backplate 1*g* may be stepped as illustrated such that it is spaced from the surrounding ceiling or wall surface. Thus, a plurality of circumferentially or radially elongated apertures 25*g* may be formed on the back of or around the rim of the base plate 1*g* and through its stepped surface to dissipate heat remotely from the architectural surface. Also, a plurality of radially extending openings 26*g* may be circumferentially spaced about the diffuser 2*g*. These openings may be circumferentially elongated or may be of any shape desired to provide sufficient heat dissipation and improved illumination. This form of lighting device is similar to that illustrated in FIGS. 3A–3C in that the electrical connection may be made prior to mechanically connecting the lighting device to the junction box or to the surrounding architectural surface. It is to be understood that this lighting device may be so constructed as to permit mechanical attachment of the lighting device prior to hardwire connection of the house wiring in a manner similar to that shown in FIGS. 4A–4C or 5A–5C. It will be appreciated that the various apertures illustrated in FIG. 7 may be applied to any embodiment of the lighting device of this invention.

Figure 8:
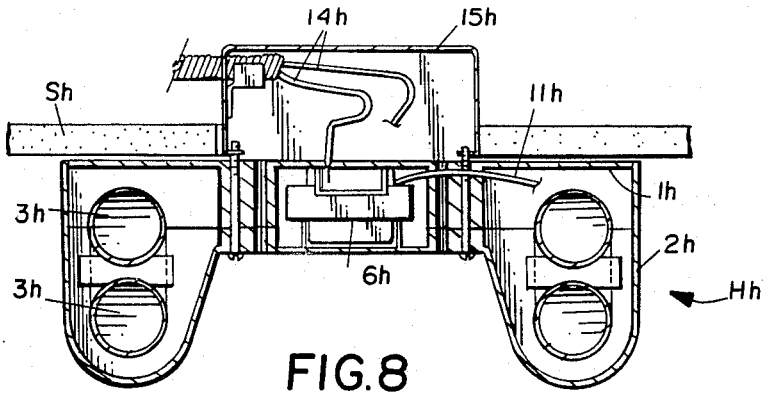
FIG. 8 is a cross-sectional view of a further embodiment of the present invention illustrating two lamps of the same size mounted one above the other within the housing.
Figure 9:
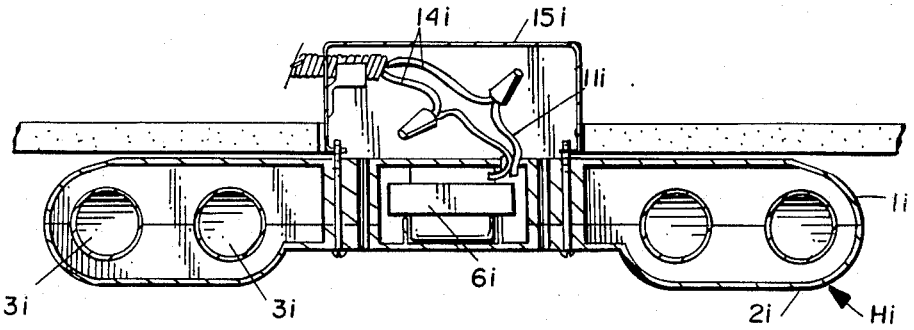
FIG. 9 is a cross-sectional view of a still further embodiment of the present invention illustrating two lamps of different sizes mounted concentric to one another within the housing.

In FIG. 8, there is illustrated a lighting device wherein a pair of similar diameter fluorescent lamps 3*h* are superposed one over the other within the housing Hh. In FIG. 9, the lamps are of different diameter and lie in a common plane. In both the embodiments of FIGS. 8 and 9, the housing Hh and Hi including the backplate and diffuser are different in shape to accommodate the different configuration of the lamps. However, the advantageous features of the present invention are retained in that the housing is integral and hardwire connections are formed between the lamp, electrical modifying means and the house wiring. It will be understood that the number and arrangement of the light sources as illustrated in FIGS. 8 and 9 and other different numbers and arrangements of the light sources may be applied to any embodiment of the lighting device of this invention.

Referring now to FIGS. 10A and 10B, there is illustrated a lighting device wherein the electrical modifying means includes a resistance element, for example, an annular resistance coil 30. Coil 30 is smaller in diameter than and lies within the plane of the circular fluorescent lamp. The lamp, resistance coil, and portions of the electrical modifying means are hardwired one to the other and to the house wiring. It is to be understood that the resistance element may take any shape other than the annular form shown as may be desired to conform to the shape of the lighting device. It will be understood that the specific form of the electrical modifying means of this embodiment as well as other forms thereof incorporating the resistance element may be applied to any embodiment of the lighting device of this invention.

Referring now to FIGS. 11A–11C, there is disclosed a quick connect mechanical-type device for mechanically coupling the lighting device exemplified by any of the embodiments hereof to the junction box, the device being similar to any number of mechanical quick-connect devices known to the trade. As will be appreciated, the junction box has inwardly extending tabs or ears 32 having apertures for receiving threaded screws. The base plate of the lighting device has suitable openings 33 formed for alignment with the openings in the ears 32. To facilitate the connection, the quick connect device illustrated comprises an elongated member 34 having a head 36 and a plurality of axially spaced, outwardly directed barbs 38. Preferably, member 34 is formed of a plastic material whereby the barbs are flexible such that they may be disposed through the aperture in ear 32 by pressing the member 34 axially inwardly toward the ear 32 and through its aperture. Once past the aperture, the barbs expand, as illustrated in FIG. 11B, to preclude removal of the member 34 and, hence, the lighting device from its connection with the junction box. To facilitate a face-to-face abutting relation between the lighting device and the surrounding surface, the member 34 is provided with a coil spring 40 between head 36 and the first barb. Thus, when the member 34 is inserted through the opening in the base plate and ear 32, spring 40 compresses to bias the lighting device in a direction toward the junction box. Member 34 is provided with a weakening notch 41 just above head 36 to permit the breaking of the head 36 to remove the lighting device when its replacement is required or desired.

Referring now to FIGS. 12A–12B, the lighting device illustrated is similar to that disclosed in FIGS. 4A–4C, except that a pair of unitary, generally U-shaped fluorescent light sources 3*k*, generally known in the market as P-L type twin tube fluorescent lamps, are provided. Suitable hardwire connections are formed between these lamps 3*k* and the electrical modifying means, as well as hardwire connectors 13*k* between the latter and the house wiring 14*k*. Also, the lighting device including its diffuser 2*k* may be provided in a generally rectangular shape to accommodate the shape of these lamps.

Referring to FIGS. 13A and 13B, while it is preferable to hardwire the connection between the lamp and the electrical modifying means, inasmuch as the housing is an integrated unit not meant for reuse when the lamp burns out but rather intended as disposable per se once the lamp extends beyond its useful life, plug-in type connections, for example, illustrated at 42 between the electrical modifying means and the lamp 31, may be provided captive within the lighting device. They are thereby not intended to enable disconnection and replacement of the lamp. This is illustrated only because such plug-in type connections are conventional and commercially available and may facilitate manufacture of this type of light device. By plug-in type connection is meant a plug having either male or female electrical connections carried by either the hardwire connection to the electrical modifying means or the lamp and a receptacle having the other of the male or female electrical connections carried by the other of the connector to the electrical modifying means and the lamp. It is to be understood that there are connectors known to the trade which serve a similar function with other types of light sources and which may be adaptable to the present invention. Consequently, such plug-in type connections therefore may be provided in any of the embodiments hereof.

Referring now to FIGS. 14A–14B, there is illustrated a light device having the hardwiring features of the present invention. In this form, the lamp **3*m* may be of the type generally known as an S-L double-bent fluorescent tube. In this form, the ballast 6*m* is mounted in a projection 43 from the backplate 1*m* and clips 44 depending from projection 43 are provided to mount the S-L type lamp. This particular lamp 3*m*** may, of course, be used in lieu of any of the other lamps disclosed in the previous embodiments hereof.

It will be appreciated by those skilled in this art that the various features and number and disposition of elements disclosed in each embodiment hereof may be used in conjunction with any one or more of the other embodiments disclosed herein. Further, it is preferred to directly connect the lighting device to the fixture, mounting plate, base or the like. However, it will also be appreciated that, for convenience or practical reasons, a separate fixture, mounting plate or base which does not contain or mount electrical connections or elements may be used.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An integrated lighting device for mounting to either an electrical box having an electrical energy source or the surface surrounding the electrical energy source comprising:

a light source;

a housing;

means non-removably and fixedly mounting said light source and said housing together;

means for supplying electrical energy from the electrical energy source to the light source including means for modifying the electrical energy supplied to the light source;

means carried by said housing for mechanically connecting said housing to one of the electrical box and the surface surrounding the energy source; and said electrical energy supplying means for supplying electrical energy between the electrical energy source and said electrical energy modifying means including at least one hardwire electrical connection therebetween and excluding any connection other than a hardwire connection therebetween.

2. An integrated lighting device according to claim 1 wherein said electrical energy supplying means for supplying electrical energy between said electrical energy modifying means and said light source includes at least one hardwire connection therebetween and excludes any connection other than a hardwire connection therebetween.

3. An integrated lighting device according to claim 1 wherein said electrical energy modifying means is carried by said housing.

4. An integrated lighting device according to claim 1 wherein said light source is carried by said housing along one side thereof, at least a portion of said electrical energy modifying means being disposed adjacent the other side of said housing for disposition within the electrical box.

5. An integrated lighting device according to claim 1 including an access panel carried by said housing providing access to the electrical energy source enabling said hardwire connection to be effected.

6. An integrated lighting device according to claim 5 wherein said lighting device has a compartment housing at least in part said electrical modifying means, said access panel being carried by said housing to provide access to said compartment from externally of said housing.

7. An integrated lighting device according to claim 1 wherein at least a portion of said light source is exposed externally of said housing.

8. An integrated lighting device according to claim 1, including a plurality of light sources non-removably mounted by said housing.

9. An integrated lighting device according to claim 1 wherein said housing includes a backplate and a diffuser permanently secured one to the other with said light source disposed therebetween and within said housing.

10. An integrated lighting device according to claim 9 wherein said electrical energy modifying means is carried by and within said housing between said diffuser and said backplate.

11. An integrated lighting device according to claim 10 wherein said light source constitutes a fluorescent lamp.

12. An integrated lighting device according to claim 10 wherein said light source constitutes an incandescent lamp.

13. An integrated lighting device according to claim 1 wherein said electrical energy supplying means for supplying electrical energy between said electrical energy modifying means and said light source includes at least one hardwire connection therebetween and excludes any connection other than a hardwire connection therebetween, including an access panel carried by said housing providing access to the electrical energy source enabling said hardwire connection to be effected.

14. An integrated lighting device according to claim 1 wherein said light source includes a plurality of discrete lamps.

15. An integrated lighting device according to claim 12 wherein said electrical energy modifying means forms an integral part of said lamp.

16. An integrated lighting device according to claim 1 wherein said electrical modifying means is carried at least in part within said light source.

17. An integrated lighting device according to claim 1 wherein said lighting device has a compartment and an access panel carried by said housing providing access to the compartment, said housing having an aperture opening on one side into the compartment and through which aperture is received the electrical energy source for hardwire connection within the compartment.

18. An integrated lighting device according to claim 17 wherein at least a part of said electrical modifying means is disposed in said compartment.

19. An integrated lighting device according to claim 1 wherein said lighting device has a compartment and an access panel carried by said housing providing access to the compartment, said compartment opening through a side of said housing providing access to the electrical energy source through said compartment.

20. An integrated lighting device according to claim 19 wherein at least a part of said electrical modifying means is disposed in said compartment.

21. An integrated lighting device according to claim 1 wherein said hardwire connection constitutes a quick connect device.

22. An integrated lighting device for mounting to either an electrical box having an electrical energy source or the surface surrounding the electrical energy source comprising:

a light source;

a housing;

means for, permanently securing said light source and said housing together to preclude replacement of said light source relative to said housing;

means for supplying electrical energy from the electrical energy source to the light source including means for modifying the electrical energy supplied to the light source; and means carried by said housing for mechanically connecting said housing directly to one of the electrical box and the surface surrounding the electrical energy source; and said electrical energy supplying means for supplying electrical energy between the electrical energy source and said electrical energy modifying means including at least one hardwire electrical connection therebetween and excluding any connection other than a hardwire connection therebetween.

23. An integrated lighting device according to claim 22 wherein said housing encapsulates said light source.

24. An integrated lighting device according to claim 22 wherein said electrical energy supplying means for supplying electrical energy between said electrical energy modifying means and said light source includes at least one hardwire connection therebetween and excludes any connection other than a hardwire connection therebetween.

25. An integrated lighting device according to claim 24 wherein said electrical energy modifying means is carried by said housing.

26. An integrated lighting device for mounting to either an electrical box having an electrical energy source or the surface surrounding the electrical energy source comprising:

a light source;

a housing;

means non-removably and fixedly mounting said light source and said housing together;

means for supplying electrical energy from the electrical energy source to the light source including means for modifying the electrical energy supplied to the light source;

means carried by said housing for mechanically connecting said housing directly to one of the electrical box and the surface surrounding the energy source and without the interposition of a separate fixture; and said electrical energy supplying means for supplying electrical energy between said light source and said electrical energy modifying means including at least one hardwire electrical connection therebetween and excluding any connection other than a hardwire connection therebetween.

27. An integrated lighting device according to claim 26 wherein said electrical energy supplying means for supplying electrical energy between said electrical energy source and said electrical energy modifying means includes at least one hardwire connection therebetween and excludes any connection other than a hardwire connection therebetween.

28. An integrated lighting device according to claim 27 including an access panel carried by said housing providing access to the electrical energy source enabling said hardwire connection to be effected between said electrical energy source and said electrical energy modifying means.

29. An integrated lighting device according to claim 27 wherein said lighting device has a compartment and an access panel carried by said housing providing access to the compartment, said housing having an aperture opening on one side into the compartment and through which aperture is received the electrical energy source for hardwire connection within the compartment.

30. An integrated lighting device according to claim 29 wherein at least a part of said electrical modifying means is disposed in said compartment.

31. An integrated lighting device according to claim 27 wherein said lighting device has a compartment and an access panel carried by said housing providing access to the compartment, said compartment opening through a side of said housing providing access to the electrical energy source through said compartment.

32. An integrated lighting device according to claim 31 wherein said electrical modifying means is at least in part located in said compartment.

* * * * *